US005636882A

United States Patent [19]

Hook

[11] Patent Number: 5,636,882

[45] Date of Patent: Jun. 10, 1997

[54] PRIVACY ADAPTOR FOR DOOR FURNITURE

[75] Inventor: John L. Hook, Doncaster, Australia

[73] Assignee: Gainsborough Hardware Industries, Ltd., Blackburn, Australia

[21] Appl. No.: 240,684

[22] PCT Filed: Nov. 12, 1992

[86] PCT No.: PCT/AU92/00609

§ 371 Date: Nov. 25, 1994

§ 102(e) Date: Nov. 25, 1994

[87] PCT Pub. No.: WO93/10324

PCT Pub. Date: May 27, 1993

(Under 37 CFR 1.47)

[30] Foreign Application Priority Data

Nov. 12, 1991 [AU] Australia ..... PK9442/91

[51] Int. Cl.[6] ..... F05B 13/00

[52] U.S. Cl. ..... 292/359; 292/336.3; 292/169.15

[58] Field of Search ..... 292/359, 169, 292/98, DIG. 30, DIG. 37, DIG. 41, 336.3, 169.14, 169.15

[56] References Cited

U.S. PATENT DOCUMENTS

| | | | |
|---|---|---|---|
| 1,479,026 | 9/1924 | Carmichael . | |
| 1,603,341 | 10/1926 | Hyatt . | |
| 1,611,999 | 12/1926 | Cummins . | |
| 2,544,959 | 3/1951 | Hillgren | 292/169 X |
| 3,136,572 | 6/1964 | Lytle | 292/359 X |
| 3,800,573 | 4/1974 | Babb, Jr. et al. . | |
| 3,885,269 | 5/1975 | Helland . | |
| 4,142,748 | 3/1979 | Hook | 292/165.15 |
| 4,296,956 | 10/1981 | Colomb | 292/169 X |
| 4,821,540 | 4/1989 | Huston | 292/359 X |
| 5,004,278 | 4/1991 | Kang et al. | 292/359 X |
| 5,074,607 | 12/1991 | Lin | 292/359 |
| 5,123,682 | 6/1992 | Robida et al. . | |
| 5,141,269 | 8/1992 | Hag et al. | 292/169 |

FOREIGN PATENT DOCUMENTS

| | | |
|---|---|---|
| 295101 | 8/1928 | United Kingdom . |
| 2090908 | 7/1982 | United Kingdom . |
| 9015210 | 12/1990 | WIPO . |

*Primary Examiner*—Rodney M. Lindsey
*Assistant Examiner*—Monica E. Millner
*Attorney, Agent, or Firm*—Sughrue, Mion, Zinn, Macpeak & Seas

[57] ABSTRACT

A releasable snib mechanism for a door latch assembly includes a body and a first rotary member disposed in the body and adapted to be engaged by and rotated with a door latch spindle. A snib member is mounted on the body for movement between a snibbing position in which the first rotary member is snibbed against rotation and a freeing position in which the first rotary member is free to rotate with the door latch spindle. A second rotary member is disposed in the body adjacent the first rotary member and is adapted to be engaged by and rotated by a shaft. This second rotary member is arranged upon initial rotation of the shaft to move the snib member from its snibbing position to its freeing position and upon continued rotation of the shaft to provide rotation to the first rotary member. According to one aspect of the invention the first and second rotary members include respective first and second formations which are disposed mutually adjacent when the rotary members are at a predetermined relative position for cooperating with a complementary snib formation on the snib member. The first formation and snib formation affect the aforementioned snibbing of the first rotary member and the second formation is effective as a cam during said initial rotation to act on the snib formation to move the snib member to its freeing position.

12 Claims, 5 Drawing Sheets

PRIVACY ADAPTOR FOR DOOR FURNITURE

FIELD OF THE INVENTION

This invention relates generally to door furniture and is concerned in particular with providing a releasible snib mechanism which may be incorporated into a door latch assembly or provided as a privacy adaptor for incorporation in a door latch assembly. In a particular though not exclusive aspect, the invention is concerned with locking systems adapted for retro-fitting to existing door furniture.

BACKGROUND ART

U.S. Pat. No. 4142748, assigned to the present applicant, disclosed a privacy lock arrangement for door latch assemblies which allows an internal door latch to be snibbed on a first side to lock the latch against entry from the other side, but to be automatically released by simple rotation of the handle at the first side. Privacy Lock arrangements in general ensure privacy for the occupant of a room against unexpected entry and are widely used on bathroom, toilet and bedroom doors. The particular arrangement of U.S. Pat. No. 4142748 includes a pair of rotary members which interengage with one another so that they can rotate independently through a limited angle of rotation only. A pivoted snib member has a first dog engageable with one of the rotary members to positively lock it against rotation and a second dog which engages the other rotary member in such a way that the relative rotation of the rotary members is effective to move the snib member out of its engagement with the locked rotary member.

The arrangement of U.S. Pat. No. 4142748 has the attraction that it may be provided as an adaptor assembly between a backing plate and an escutcheon and therefore does not require modification of the handle, but is also a relatively complex mechanism to manufacture.

Earlier privacy lock arrangements are to found, for example, in U.S. Pat. No. 471190, and in British patents 861002 and 1159161.

A variation of the arrangement of U.S. Pat. No. 4142748 is disclosed in the present applicant's co-pending Australian patent application 19655192. In that case, the engagement between the releasing rotary member and the snib is by way of a lateral pin on the snib which projects parallel to the main spindle axis and is received in a V-shaped cut-out in a head portion of the rotary member.

DISCLOSURE OF THE INVENTION

It is an object of the present invention to provide a releasible snib mechanism for a door latch assembly which may be employed as an improved privacy lock arrangement.

The invention accordingly provides, in one aspect, a releasible snib mechanism for a door latch assembly which includes a body, and a first rotary member disposed in the body and adapted to be engaged by and rotated with a door latch spindle. A snib member is mounted on the body for movement between a snibbing position in which the first rotary member is snibbed against rotation and a freeing position in which the first rotary member is free to rotate with the door latch spindle. A second rotary member is disposed in the body adjacent the first rotary member and is adapted to be engaged by and rotated by a shaft means. This second rotary member is arranged upon initial rotation of the shaft means to move the snib member from its snibbing position to its freeing position and upon continued rotation of the shaft means to provide rotation to the first rotary member. The first and second rotary members include respective first and second formations which are disposed mutually adjacent when the rotary members are at a predetermined relative position, for cooperating with a complementary snib formation on the snib member. The first formation and snib formation affect the aforementioned snibbing of the first rotary member and the second formation is effective as camming means during said initial rotation to act on the snib formation to move the snib member to its freeing position.

In a further aspect of the invention, there is provided a releasible snib mechanism for a door latch assembly which includes a body and a first rotary member disposed in the body and adapted to be engaged by and rotated with a door latch spindle. A snib member is mounted on the body for movement between a snibbing position in which the first rotary member is snibbed against rotation and a freeing position in which the first rotary member is free to rotate with the door latch spindle. A second rotary member is disposed in the body adjacent the first rotary member and is adapted to be engaged by and rotated by a shaft means. This second rotary member is arranged upon initial rotation of the shaft means to move the snib member from its snibbing position to its freeing position and upon continued rotation of the shaft means to provide rotation to the first rotary member. Means is provided to bias the rotary members to a predetermined relative rotational position, and this biasing means comprises a coil spring disposed within the aforesaid body so as to be compressible by one or either of the rotary members when they rotate.

BRIEF DESCRIPTION OF THE DRAWINGS

The invention will now be further described, by way of example only, with reference to the accompanying drawings, in which.

DETAILED DESCRIPTION OF PREFERRED EMBODIMENT

Figure 1:
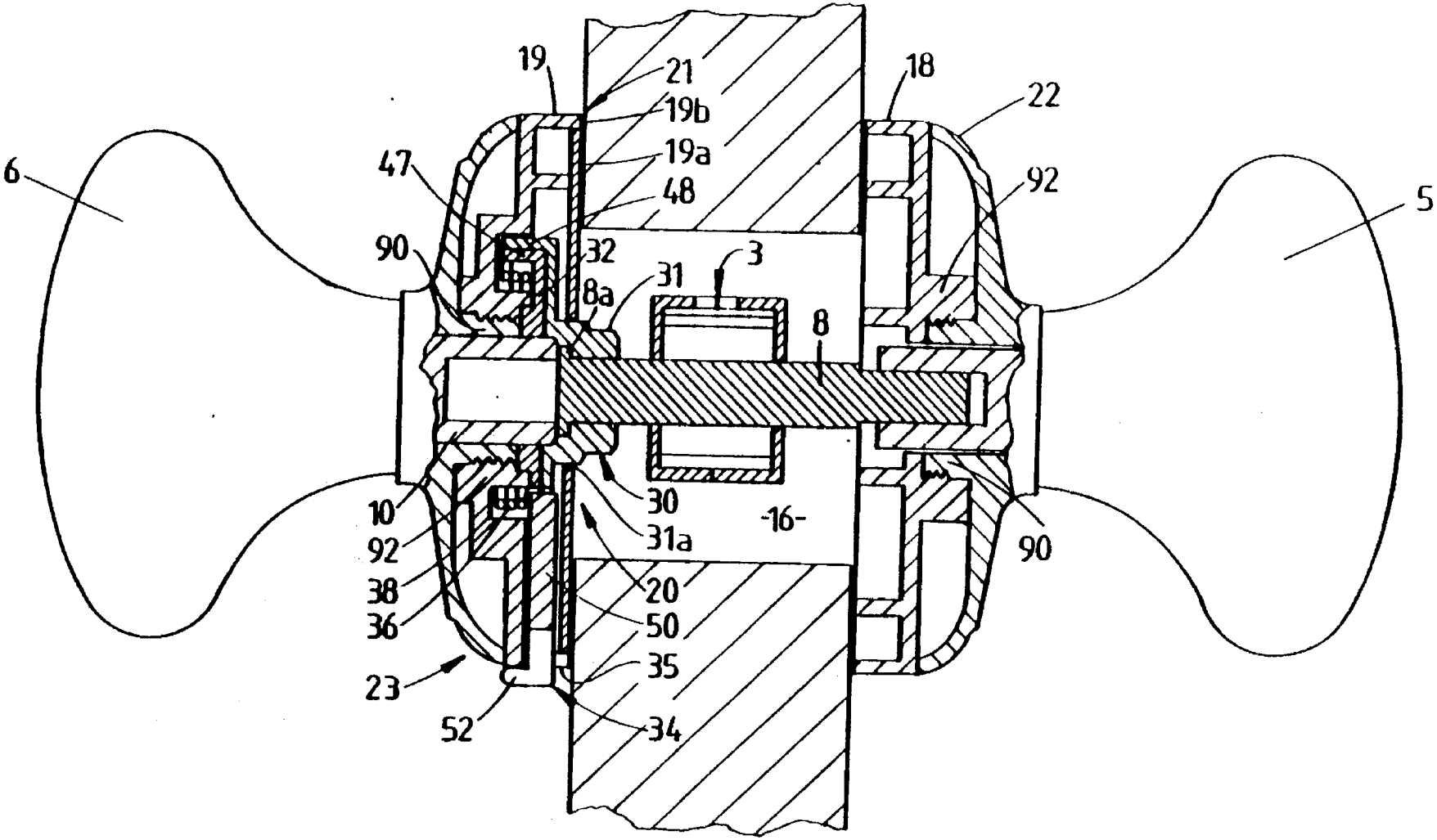
FIG. 1 is a partially sectioned, somewhat diagrammatic axial view of a door latch assembly in situ, having a privacy adaptor which incorporates a releasible snib mechanism according to an embodiment of the invention.
Figure 2:
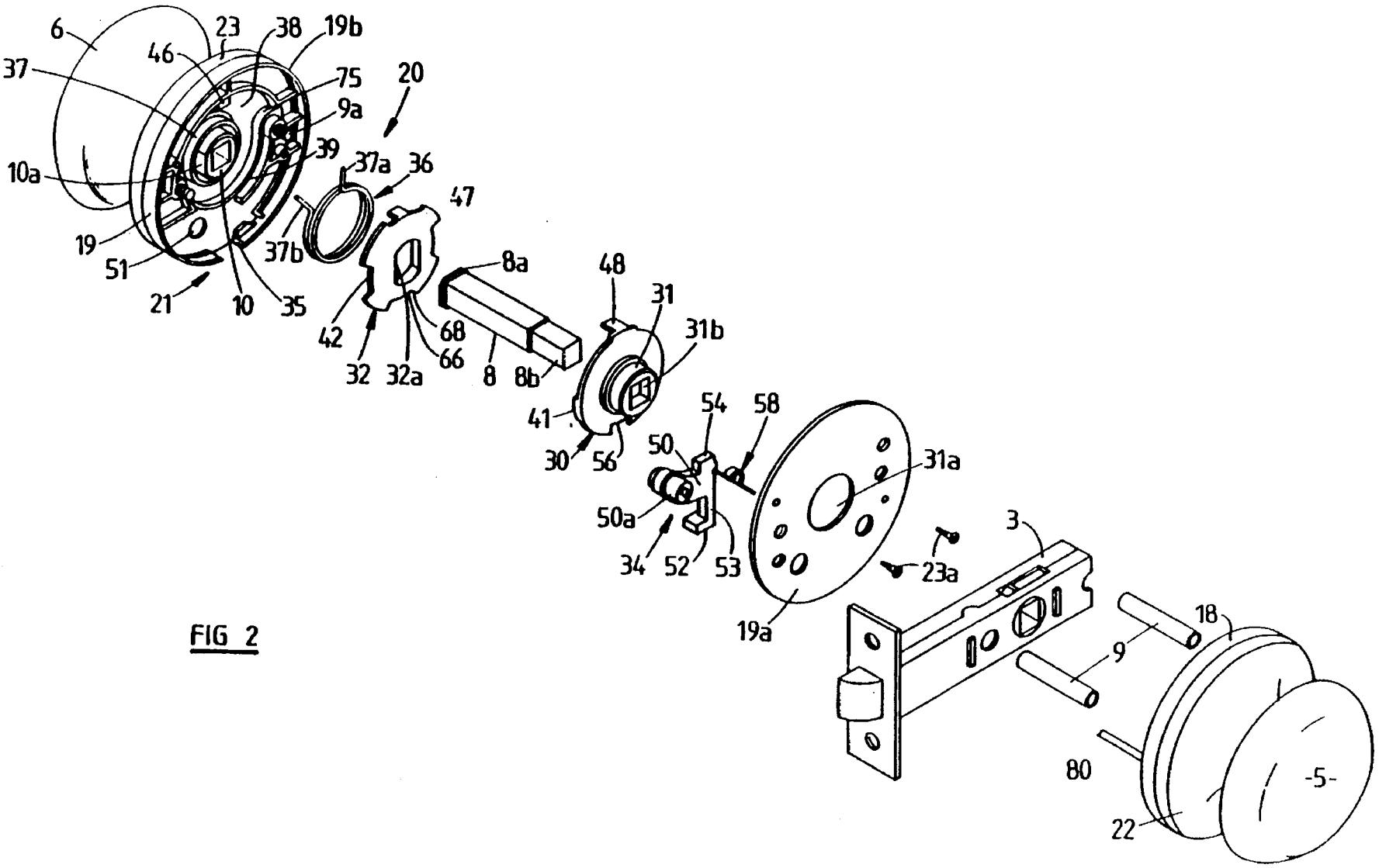
FIG. 2 is an exploded perspective view of the door latch assembly shown in FIG. 1.
Figure 3:
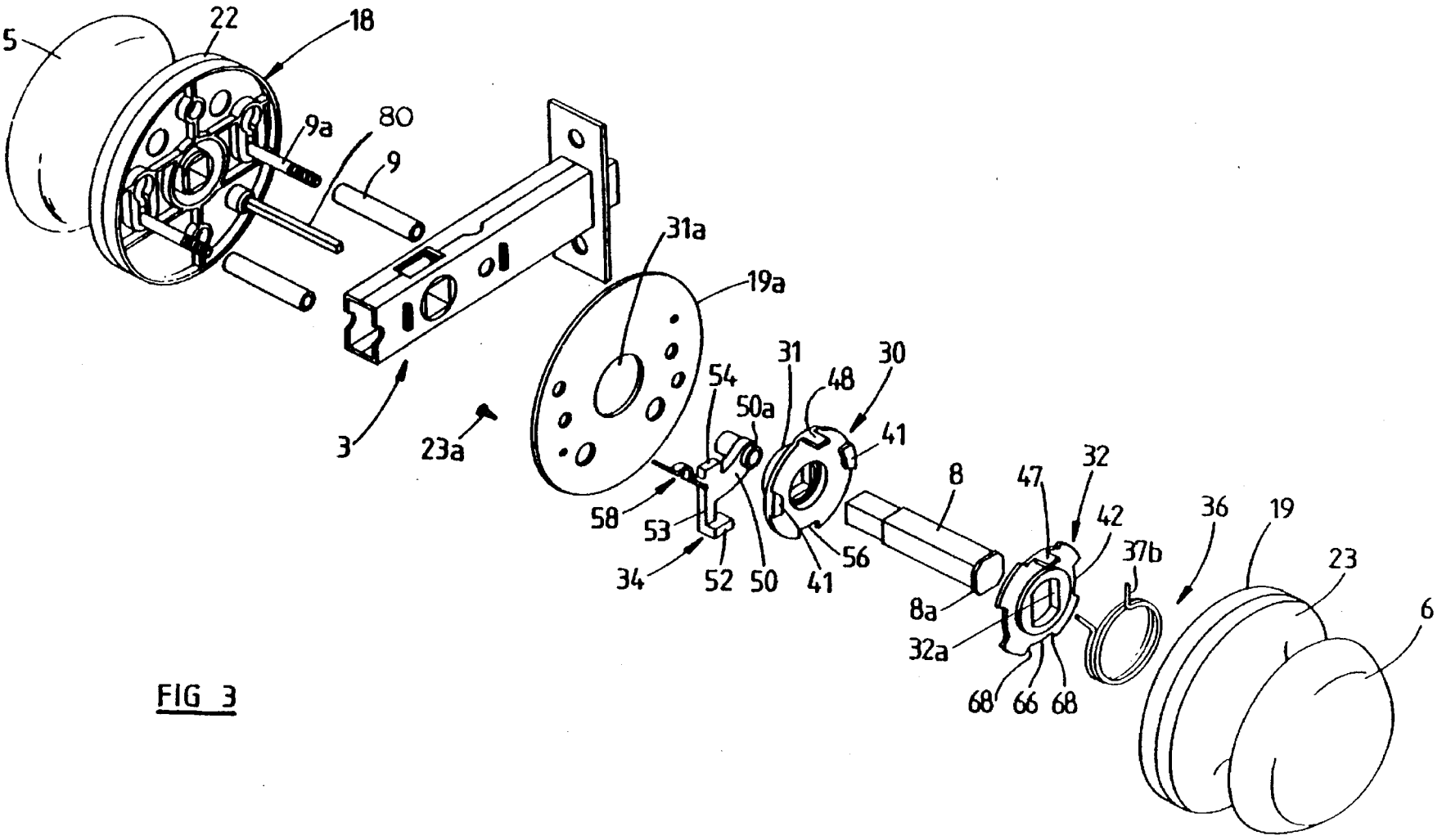
FIG. 3 is a similar view from a different angle.

The illustrated door latch assembly includes a pair of knob handles 5,6. Handle 5, which in situ would normally be disposed at the outside of the door, is fitted with a shaft 10*a* having a square-section bore by which it is mounted on a square-section spindle 8. Spindle 8 passes through and is operatively coupled to a latch mechanism 3 of conventional form. Handle 6 is disposed at the inside of the door and is fitted with a hollow shaft 10 similar to shaft 10*a*. Spindle 8 and shaft 10 are coaxial and are coupled within a snib mechanism 20 comprising an embodiment of the invention. The necessary standard door cavity 16 is covered at each side of the door by respective backing plates 18, 19 and by escutcheon plates 22, 23. The escutcheon plates have externally threaded bosses 90 by which they are threadably engaged with matching threaded sockets 92 on the respective backing plates. The backing plates are assembled together in the usual manner by a pair of posts 9 which extend through latch mechanism 3 and are threadably attached (e.g. by screws 9*a*) to the respective backing plates.

Snib mechanism 20 is provided within a privacy adaptor 21 which is substituted for a conventional backing plate such as backing plate 18 on the outside of the door. Privacy adaptor 21 includes a self-contained housing for mechanism 20 comprising backing plate 19 and a rear cover plate 19*a*. Cover plate 19*a* fits within the rim 19*b* of plate 19 and is fastened thereto by small screws 23*a* or other suitable fasteners such as rivets.

The principal components of mechanism 20 are a first rotary member or disc 30 irrotationally engaged with latch spindle 8, a superposed second rotary member or disc 32 similarly coupled, by virtue of complementary flats 32*a*, 10*a*, to the free end of shaft 10, a pivotally mounted snib 34 including a manually engageable head 52 projecting through a peripheral recess 35 in the rim 19*b* of backing plate 19, and a coil spring 36 captive under disc 32. Discs 30, 32 are coaxial with spindle 8 and shaft 10. Backing plate 19 is a cast component provided internally with an annular depression 38 to seat coil spring 36, defined between an inner ring 37 and a part annular inner rim 39 which together provide a co-planar seat for disc 32.

Disc 30 has a boss 31 which seats in a central aperture 31*a* in cover plate 19*a*, thereby locating the disc. This boss has a central square section bore 31*b* which receives spindle 8. Spindle 8 has a head 8*a* which is disposed in a counterbore of disc 30 and engages disc 30 so that it cannot pass through bore 31*b*. The other end of spindle 8 is an open end for engaging a handle or other mechanism on the other side of the door in a manner allowing for variation of a door width.

Discs 30, 32 are interengaged by a simple lost motion mechanism 40 comprising a pair of diametrically opposite peripheral lugs 41 on disc 30 and complementary limited arcuate notches 42 in the rim of disc 32. Notches 42 are peripherally longer than the lugs 41 they seat, whereby rotation of handle 6 will effect an initial rotation of disc 32 which is not transmitted to disc 30 and spindle 8, and a subsequent continued rotation which is so transmitted.

Figure 7:
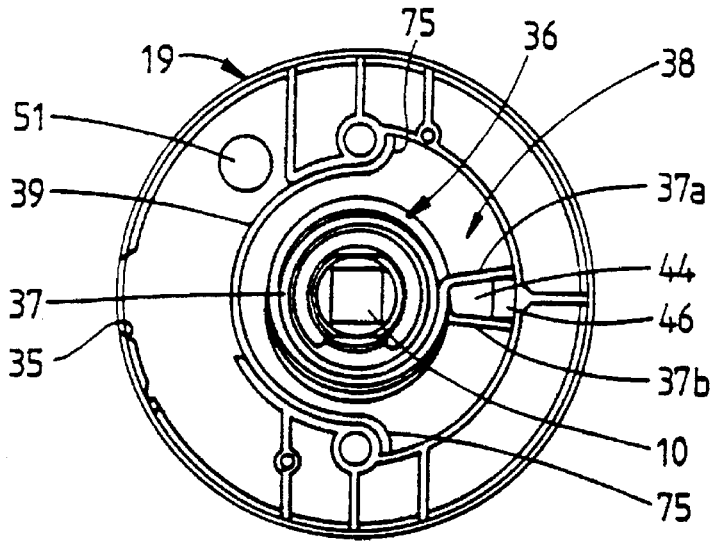
FIG. 7 is a fragmentary elevational view corresponding to FIG. 4 but showing the discs and snibs removed from the adaptor to reveal the coil spring in situ.
Figure 8:
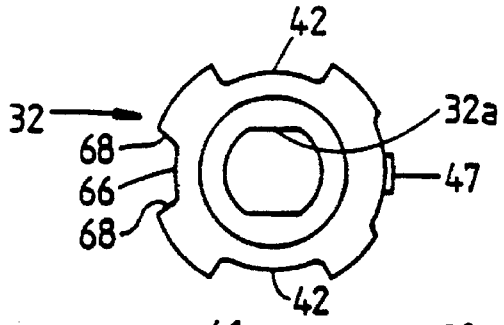
FIG. 8 is a front elevation of one of the discs.
Figure 9:
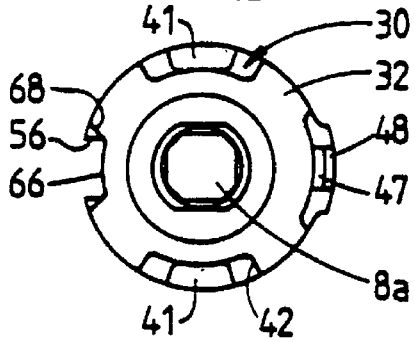
FIGS. 9 and 10 are front and side elevational views of the sub-assembly of the discs and main spindle.
Figure 10:
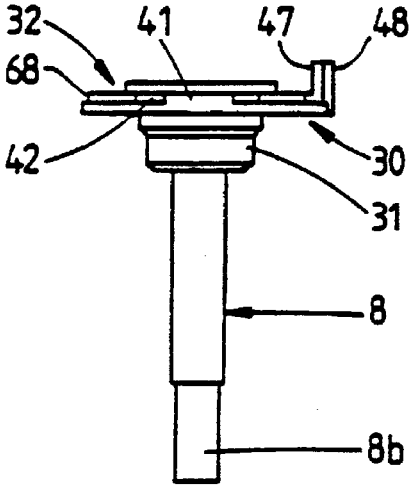

Discs 30, 32 are biased to a predetermined relative position, in which lugs 41 are angularly centered in notches 42, by means of coil spring 36. Spring 36 has three coils and terminal radial arms 37*a*, 37*b* which, in situ, angularly overlap and engage either side of a small integral land 46 projecting into depression 38 from its outer periphery (FIG. 7). A tab 47 at the rim 32 of disc 32 and a radially outwardly adjacent tab 48 at the rim of disc 30 project parallel to the spindle/shaft axis, in the predetermined equilibrium position, into depression 38 in the space 44 radially inwardly of land 46 between terminal spring arms 37*a*, 37*b*. It will be appreciated from FIG. 7 that rotation of either of discs 30, 32 from the equilibrium position will be opposed by compression of the coil spring, as the respective tab 47, 48 engages and moves a spring arm. This single coil spring therefore acts to return either of handles 5 and 6 and the spindle 8 to the equilibrium position. As will be seen, this is important for the proper functioning of the privacy lock mechanism. The coil spring engagement also overcomes the potential problem that the return springs of many latch configurations do not reliably return the spindle to the normal position, for a variety of practical reasons.

The limits of rotation of discs 30, 32 are set by engagement of spring arms 37*a*, 37*b* against radial shoulders 75 in depression 38.

Figure 6:
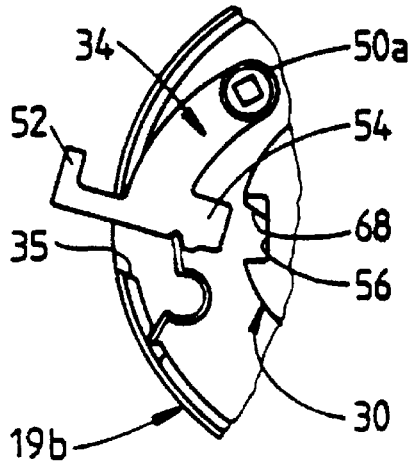

Snib 34 includes a main flat body 50 with boss 50*a* by which it is journalled at one end in an aperture 51 in backing plate 19 so as to project generally circumferentially with respect to the axis of discs 30, 32. Snib 34 is pivotable in aperture 51 about an axis parallel to the common axis of spindle 8, shaft 10 and discs 30, 32. The snib further includes a leg 53 terminating in head 52 which projects radially out through recess 35 to provide a finger engaging portion. Radially inwardly contiguous with leg 53 at the free end of body 50 is a locking lug 54 which is of generally rectangular configuration and has side surfaces contiguous with those of body 50 and leg 53. The snib is movable between an inner snibbing position (FIG. 4) in which lug 54 engages a rectangular notch 56 on the periphery of disc 30 and thereby snibs disc 30 against rotation, and a freeing position (FIG. 6) in which the lug is clear of notch 56 so that the disc, and spindle 8, are free to rotate.

Figure 4:
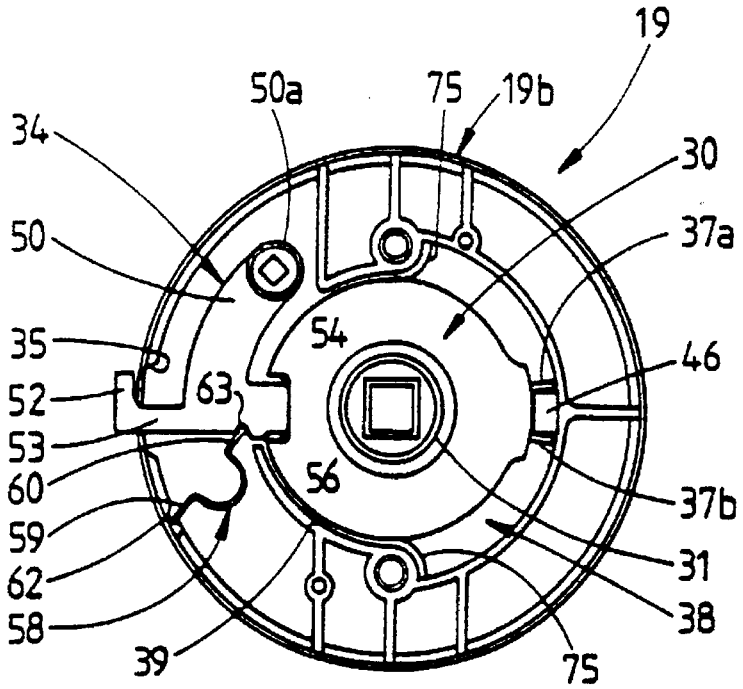
FIG. 4 is a rear elevational view of the privacy adaptor with a back plate removed, showing the mechanism in the snibbing position.

Setting of snib 34 in either of these positions is facilitated by a U-shaped indexing spring 58 which has outturned terminal legs 59, 60 (FIG. 4). These legs tightly seat in respective V-shaped notches 62, 63 on the rim of backing plate 19 and in snib 34. The arrangement is such that the minimum separation of the legs of this spring occurs when the snib is approximately mid-way between the snibbing and freeing positions, whereby the spring biases the snib toward whichever of the positions it is approaching.

Figure 5:
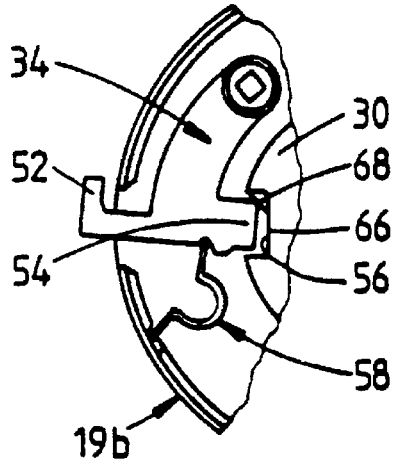
FIGS. 5 and 6 are fragmentary views corresponding to part of FIG. 4 but depicted the movement of the mechanism to the release position.

When it is engaged in notch 56, locking lug 54 is also received in a further notch 66 on disc 32. Notches 56, 66 lie in register at the relative equilibrium position of discs 30, 32 determined by spring 36, but notch 66 differs from notch 56 in that it has inclined edges 68 at each side rather than radial edges as in the case of notch 56. These edges 68 are effective as a camming means during the aforesaid initial rotation of disc 32 to act on locking lug 54 to move snib 34 to its freeing position, as illustrated in FIG. 5.

It will be seen that the arrangement is symmetrical in that rotation of handle 6 and therefore disc 32 in either direction will release snib 34. It will also be seen that snib lug 54 is of a thickness about equal to the combined thicknesses of the two discs.

By setting snib 34 manually to its snibbing position (FIG. 4) by pushing in head 52, disc 30, and accordingly outside handle 5, are locked against rotation. However, the snib 34 is automatically released from the inside of the door in that initial rotation of handle 6 will release the snib (FIGS. 5, 6) to allow the handle to then rotate disc 30 and spindle 8 on continuing rotation of the handle.

The assembly also provides a means for emergency release of the snib from the outside. A square-section shaft 80 engages a complementary bore in snib boss 5o*a* and extends across door cavity 16. This shaft has an upturned leg within backing plate 18 at the outside of the door. This leg can be engaged, by a suitable tool through an aperture (not visible) in the rim of plate 18, and rotated to in turn rotate snib 34 to the freeing position.

It has already been pointed out that coil spring 36 acts to return either of discs 30, 32 to an equilibrium position on rotation by the knob in either direction. The spring thus also serves to ensure that notches 56, 66 are in register to receive locking lug 54 when it is desired to set snib 34 in the privacy lock or snibbing position. Coil spring 36 thus performs multiple functions. The spring in this form is a substantial improvement on the typical arcuately mounted helical compression spring used in prior privacy lock arrangements such as that of U.S. Pat. No. 4142748. The helical compression spring was found to be noisy in situ and entailed a rapid increase in the opposing return force as the handle was turned. The coil spring is believed to be much less noisy and, by having plural coils, the return force only increases slowly with advancing rotation of the knob.

It will be understood that the mechanism 20, enclosed as a self-contained unit within plates 19, 19*a*, is depicted as an adaptor for inclusion and mounting in either new latch kits or for retro-fitting to existing latch installations. It will be further appreciated that the illustrated arrangement provides a fully universal simple and durable privacy mechanism adaptable to a full range of latch fittings and locations on doors. There are fewer components than in prior arrangements and those components are of simpler construction by virtue of the common engagement of the snib locking lug with the respective peripheral notches of the two discs. The design is suitable for pre-drilled as well as flush panel doors, does not require a self-aligning latch and is suitable for both left- and right-hand mounting as well as for both knob and lever handle sets.

I claim:

1. A releasible snib mechanism for a door latch assembly comprising:

a body;

a first rotary member disposed in said body for rotation about a first axis and adapted to be engaged by and rotated with a door latch spindle;

a snib member mounted on the body for movement between a snibbing position in which said first rotary member is snibbed against rotation and a fleeing position in which said first rotary member is free to rotate with the door latch spindle;

a second rotary member disposed in said body adjacent the first rotary member and adapted to be engaged by and rotated about said first axis by a shaft means, said second rotary member being arranged upon initial rotation of said shaft means to move said snib member from said snibbing position to said fleeing position and upon continued rotation of said shaft means to provide rotation to said first rotary member; and means to bias said rotary members to a predetermined relative rotational position, said biasing means comprises a coil spring disposed within said body, said coil spring comprising a coil having an axis substantially coincident with said first axis of rotation of said first and second rotary members, and two spring arms extending generally radially from the coil, means retaining the spring arms within the body such that the two spring arms lie one adjacent the other with a space defined between the two arms, said first and second rotary members each having a projection extending into the space whereby rotation of either of said members out of said predetermined position in one rotational direction causes the projection of that member to angularly displace one of the spring arms against the bias provided by the coil spring, and rotation of either of said members out of said predetermined position in a second rotational direction causes the projection of that member to angularly displace the other of the spring arms against the bias provided by the coil spring, wherein said rotary members are interengaged by lost motion means comprising projection means on one of the rotary members and recess means in the other rotary member, whereby during said initial rotation of the second rotary member, the rotation is not transmitted to the first rotary member, whereas said continued rotation is so transmitted, wherein said predetermining relative rotational position of said first and second rotary members as determined by the co-operation of said projections with said spring arms is an intermediate position between limits of lost motion provided by said lost motion means.

2. A snib mechanism according to claim 1, wherein said first and second rotary members include respective first and second formations which are disposed mutually adjacent when said rotary members are at said predetermined relative rotational position, for cooperating with a complementary snib formation on the snib member, the first formation and snib formation effecting said snibbing of the first rotary member and said second formation being effective as camming means during said initial rotation to act on said snib formation to move said snib member to said freeing position.

3. A releasable snib mechanism according to claim 2, wherein the snib member is mounted for rotation about a second axis substantially parallel to and offset from said first axis, and said emergency release means comprises a release shaft mounted on said second axis, said release shaft being rotatable about said second axis to thereby rotate the snib member to said freeing position.

4. A releasable snib mechanism for a door latch assembly, said mechanism includes:

a body;

a first rotary member disposed in said body for rotation about a first axis, said first rotary member engaging a door latch spindle for rotation therewith;

a snib member mounted on said body for movement between a snibbing position in which said first rotary member is snibbed against rotation and a freeing position in which said first rotary member is free to rotate with the door latch spindle;

a second rotary member disposed in said body adjacent the first rotary member, said second rotary member engaging a shaft means for rotation therewith about said first axis, said second rotary member including a camming means wherein initial rotation of said shaft means causes said camming means to engage said snib member and thereby move said snib member from said snibbing position to said freeing position, and wherein continued rotation of said shaft means provides rotation to said first rotary member; and biasing means to bias said rotary members to a predetermined relative rotational position, said biasing means includes a coil spring disposed within said body, said coil spring including a coil having an axis substantially aligned with said first axis of rotation of said first and second rotary members, and two spring arms extending generally radially from the coil, retaining means for retaining said spring arms within said body such that said two spring arms lie one adjacent the other with a space defined therebetween, said first and second rotary members each having a projection extending into the space whereby rotation of either of said members out of said predetermined position in one rotational direction causes the projection of that member to angularly displace one of said spring arms against the bias provided by said coil spring, and rotation of either of said members out of said predetermined position in a second rotational direction causes the projection of that member to angularly displace the other of the spring arms against the bias provided by the coil spring.

5. A releasable snib mechanism according to claim 4, wherein said snib mechanism includes emergency release means operable from the opposite side of the door to that having the snib member, said emergency release means operable to move said snib member from the snibbing position to the freeing position, the snib member being mounted for rotation about a second axis substantially parallel to and offset from said first axis, and said emergency release means comprising a release shaft mounted on said second axis, said release shaft being rotatable about said second axis to thereby rotate the snib member to said freeing position.

6. A releasible snib mechanism according to claim 2, wherein said first and second rotary members comprise respective disc members.

7. A releasible snib mechanism according to claim 2 wherein said first and second formations are at the peripheries of the respective disc members.

8. A releasible snib mechanism according to claim 7, wherein said first and second formations include respective notches at the peripheries of said disc members, the second formation further including one or more faces of the respective notch which provide said camming means.

9. A releasible snib mechanism according to claim 7, wherein said snib formation includes a lug on said snib member which is received by both of said notches in said snibbing position.

10. A releasible snib mechanism according to claim 1 wherein said snib member is rotatably mounted on said body and includes an exposed finger engaging portion for effecting movement of the snib member at least from said freeing position to said snibbing position.

11. A releasible snib mechanism according to claim 1 further comprising an indexing spring means to bias said snib member to said snibbing position and to said freeing position.

12. A releasible snib mechanism according to claim 1, further comprising emergency release means operable from another side of the door to move said snib member from the snibbing position to the freeing position.

* * * * *